US005407792A

United States Patent [19]

Rüger

[11] Patent Number: 5,407,792

[45] Date of Patent: Apr. 18, 1995

[54] PHOTOSENSITIVE SILVER HALIDE RECORDING MATERIAL WITH REDUCED PRESSURE SENSITIVITY

[75] Inventor: Reinhold Rüger, Rödermark, Germany

[73] Assignee: E. I. Du Pont de Nemours and Company, Wilmington, Del.

[21] Appl. No.: 220,327

[22] Filed: Mar. 30, 1994

[30] Foreign Application Priority Data

Apr. 10, 1993 [DE] Germany ..... 43 11 888.7

[51] Int. Cl.[6] ..... G03C 1/76

[52] U.S. Cl. ..... 430/536; 430/523; 430/537; 430/961; 430/627

[58] Field of Search ..... 430/523, 536, 537, 961, 430/627

[56] References Cited

U.S. PATENT DOCUMENTS

| | | | |
|---|---|---|---|
| 3,642,480 | 2/1972 | Vrancken | 430/294 |
| 4,168,977 | 9/1979 | Takada et al. | 430/446 |
| 4,214,047 | 7/1980 | Chen | 430/537 |
| 4,224,401 | 9/1980 | Takada et al. | 430/137 |
| 4,226,927 | 10/1980 | Kinderman et al. | 430/14 |
| 4,409,322 | 10/1983 | Ezaki et al. | 430/537 |
| 4,937,160 | 6/1990 | Rüger | 430/264 |
| 5,013,844 | 5/1991 | Rüger | 546/332 |
| 5,130,480 | 7/1992 | Rüger | 564/151 |
| 5,190,847 | 3/1993 | Chan et al. | 430/264 |
| 5,310,639 | 5/1994 | Lushington et al. | 430/539 |

FOREIGN PATENT DOCUMENTS

| | | |
|---|---|---|
| 0032456B1 | 2/1983 | European Pat. Off. . |
| 0126000A2 | 11/1984 | European Pat. Off. . |
| 0209010A2 | 1/1987 | European Pat. Off. . |
| 0126000B1 | 8/1987 | European Pat. Off. . |
| 0324381A2 | 7/1989 | European Pat. Off. . |
| 0324391A3 | 7/1989 | European Pat. Off. . |
| 0324426A | 7/1989 | European Pat. Off. . |
| 0324426A3 | 7/1989 | European Pat. Off. . |
| 0326443A2 | 8/1989 | European Pat. Off. . |
| 0203521B1 | 12/1989 | European Pat. Off. . |
| 0138200B1 | 1/1990 | European Pat. Off. . |
| 0356898A2 | 3/1990 | European Pat. Off. . |
| 0253665B1 | 1/1992 | European Pat. Off. . |
| 0473342A1 | 3/1992 | European Pat. Off. . |
| 0490302A2 | 6/1992 | European Pat. Off. . |
| 0501546A1 | 9/1992 | European Pat. Off. . |
| 0217310B1 | 11/1992 | European Pat. Off. . |
| 0520394 | 12/1992 | European Pat. Off. . |
| 2725743B2 | 6/1980 | Germany . |
| 0212339 | 11/1982 | Germany . |
| 212339 | 11/1982 | Germany . |

OTHER PUBLICATIONS

Verlag, Carl Hauser, *Synthetic Resin Handbook*, IV, 161–165, 1969.

Research Disclosure 308119, Disclosed Anonymously, "Photographic silver halide emulsions, preparations, addenda, processing and systems," Dec. 1989, pp. 993–1015.

Research Disclosure 23510, Disclosed Anonymously, "Development nucleation by hydrazine and hydrazine derivatives," Nov. 1983, pp. 346–352.

Ullman et al., "Encyclopedia of Industrial Chemistry," 4th Edition, Verlag Chemie, Weinheim, 1983, pp. 1–49.

*Primary Examiner*—Thomas R. Neville

[57] ABSTRACT

The present invention relates to photosensitive silver halide recording material with reduced pressure sensitivity. The occurrence of pressure marks can be minimized by protective layers with suitable additives. Other properties of the recording material, such as sensitivity, contrast, and clarity, are not affected adversely. Recording materials with protective layers containing polyolefin oxidates are largely insensitive to pressure marks and have low haze, high sensitivity, and high contrast. The invention's recording materials can be used in all fields of photographic and radiographic image production, especially in reproducing color images in steps preliminary to printing and in recording x-ray images for medical diagnostics.

9 Claims, No Drawings

PHOTOSENSITIVE SILVER HALIDE RECORDING MATERIAL WITH REDUCED PRESSURE SENSITIVITY

BACKGROUND OF THE INVENTION

1.Field of the Invention

This invention relates to a photosensitive recording material with reduced pressure sensitivity.

2.Description of Related Art

During manufacture, storage, and processing, photosensitive silver halide recording materials are moved while in contact with surfaces of, for example, other films, guide rollers, and metal plates in exposure devices, cassettes, and development machines. Such surfaces have irregularities or peaks due to dirt, dust, scratches, or matte agents. The tips of such peaks exert considerable pressure on the material's surface, a pressure that is transferred to the silver halide grains and that can lead to pressure sensitization. Developing the materials blackens these contact sites even if not exposed, producing gray or black pressure marks. This occurs even if the outer layer has not been damaged mechanically. The pressure marks are usually black lines, that degrade the recorded image. Such black pressure marks are especially disadvantageous in phototypesetting film and in films that are processed by infectious development.

The problem of pressure sensitivity has assumed greater significance with the trend to more rapid and largely automatic handling of the materials, for example, during exposure. The problem cannot be solved by simply increasing the binder in the emulsion or the thickness of the protective coating, because of concurrent requirements for rapid processing.

Patent Application EP 02 09 010-A2 describes recording materials with ultrahigh contrast and reduced pressure sensitivity and containing polyhydroxybenzenes, for example, hydroquinone. However, the pressure sensitivity of these materials drops only after long storage, and photosensitivity decreases simultaneously.

Patent Application EP 04 90 302-A2 proposes adding silica to the emulsion layer and limiting the coefficient of friction by incorporating a slip agent in the protective layer.

Incorporating soft polymer latexes in the emulsion layer or in the top layer is also known to reduce pressure sensitivity (see, for example, Research Disclosure 308 119, December 1989).

The known methods do indeed yield a certain reduction in pressure sensitivity, but a reduction which, in many cases, is inadequate. Furthermore, slip agents or latexes incorporated in the coatings, especially in larger quantities, produce an array of other disadvantages, such as tackiness, reduced scratch resistance, haze, and the need for longer processing times. Colloidal silica damages the planarity of the material and increases the viscosity of coating solutions in an undesirable manner.

The problem involved in the invention is to make a rapidly processible, photosensitive silver halide recording material that is largely insensitive to the occurrence of pressure marks and has low haze and optimum sensitometric properties.

SUMMARY OF THE INVENTION

This problem is solved by a photosensitive silver halide recording material with a support and at least one layer system comprising at least one silver halide emulsion layer and an outer protective layer containing a hydrophilic colloid on the side of the layer system away from the support, characterized in that the protective layer contains a polyolefin oxidate.

DESCRIPTION OF THE PREFERRED EMBODIMENT(S)

Polyolefin oxidates are products with molecules consisting of a polyolefin chain with functional groups produced by oxidation, essentially carboxyl and hydroxyl groups. Their preparation and properties are described, for example, in the "Synthetic Resin Handbook", volume IV, pages 161 ff. (Carl Hanser Verlag, Munich, 1969) and in Ullmann's "Encyclopedia of Industrial Chemistry", 4th edition, volume 24, pages 24ff. (Verlag Chemie, Weinheim, 1983). Suitable products are commercially available pure or as aqueous dispersions.

The use of oxidized polyethylene as the final coating on antihalation backings containing carbon black to improve adhesion, scratch resistance, abrasion resistance and behavior in alkaline development baths is described in Patent DD 02 12 339. However, one skilled in the art would not expect that polyolefin oxidates in the protective layer over the emulsion layer prevent the formation of pressure marks.

The preferred hydrophilic colloid in the protective layer is gelatin. However, other macromolecular hydrophilic materials can be used, for example, polyacrylamide, polyvinyl alcohol, and copolymers of the corresponding monomers, optionally also with acrylic acid.

The preferred polyolefin oxidate in the protective layer of the invention's recording materials is a polyethylene oxidate.

The proportion of polyolefin oxidate in the protective layer can be 2 to 85 percent by weight, preferably between 5 and 70 percent by weight. An especially preferred range is between 20 and 60 percent by weight.

The properties of the polyolefin oxidates are measured by DGF Standard Methods, Section M: Waxes and Wax Products, Stuttgart, 1975, of the Deutschen Gesellschaft für Fettwissenschaft.

The invention's preferred polyolefin oxidates have a ball-puncture resistance, by method DGF-M-III 9*a*, between 150 and 1100 bar, the range of 250–1100 bar being especially preferred.

The preferred molar mass of the invention's polyolefin oxidates is between 3000 and 8000 g/mole.

The acid number of the invention's polyolefin oxidates is between 10 and 35 mg KOH per gram. The preferred range is 15 to 25 mg KOH per gram.

Preferred polyolefin oxidates have a melting point of 90° to 140° C, determined according to DIN 53736.

It is recommended that the polyolefin oxidates be processed into an aqueous dispersion for incorporation in coating solutions. This can be done in the known manner by heating and stirring a mixture with water above the melting point, optionally under increased pressure, and preferably in the presence of an alkali hydroxide. The particle size of the dispersion should be below 200 nm, preferably between 50 and 100 nm.

In contrast to other polymer dispersions it is surprising that polyolefin oxidates do not significantly hinder, even at high proportions in the protective layer, access of processing solutions to the photosensitive emulsion layer. Therefore, the suitability of the materials for rapid processing is not diminished.

The thickness of the protective layer of the invention's recording materials can be selected within wide limits depending on end use and desired properties. A preferred range is characterized by the dried layer having a coating weight between 0.1 and 1.5 g/m$^2$. The range between 0.5 and 1.2 g/m$^2$ is especially preferred.

The photosensitive silver halides of the invention's recording materials are silver chloride, silver bromide, silver chlorobromide, silver bromoiodide, or silver chlorobromoiodide. They can be monodisperse or polydisperse, they can be homogeneous or have a core-shell structure, and they can be mixtures of grains of various compositions and grain size distribution. The grain shape can be predominantly spherical, polyhedral, or tabular. The silver halides are prepared with a hydrophilic, colloidal binder, preferably gelatin. Methods for preparing suitable photosensitive silver halide emulsions are known to one skilled in the art and are summarized, for example, in Research Disclosure 308 119 (December 1989).

The size of the silver halide grains in the emulsions is adapted for the required sensitivity and can be, for example, between 0.1 and 1 μm. Noble metal salts, particularly rhodium or iridium salts, can be present in the usual quantities to improve photographic properties.

The preferred emulsions are sensitized chemically. Suitable processes are sulfur, reduction, and noble metal sensitization, which can also be used in combinations. For example, gold or iridium compounds can be used in the latter.

The emulsions can be sensitized spectrally with the usual sensitizing dyes.

The emulsions can also contain the usual antifoggants. Tetraazaindenes, optionally substituted benzotriazole, 5-nitro-indazole, and mercury chloride are preferred. These agents can be added at any time during emulsion preparation or can be contained in an auxiliary layer of the photographic material. An iodide in a quantity of about 1mmole per mole of silver can be added to the emulsion before or after chemical ripening to improve photographic properties.

The photographic material can contain other additives that are standard and known to produce specific properties. Such additives are summarized, for example, in Research Disclosure 308 119 in Sections V (Optical Brighteners), XI (Coating Aids), XII (Plasticizers and Slip Agents), and XVI (Matte Agents).

The gelatin content of the emulsions is generally between 50 and 200 g per mole of silver, the range between 70 and 150 g per mole of silver being preferred.

The preferred recording materials of the invention contain a hydrazine compound to increase contrast. This hydrazine compound can be incorporated in a known manner either in the silver halide emulsion layer or in an auxiliary layer with a reactive relationship to the emulsion layer. "Reactive relationship"here means that the hydrazine compound or its reaction products can migrate into the emulsion layer at least during the action of an aqueous alkaline developer solution. Examples of suitable compounds and incorporation methods are described in Research Disclosure 235 010 (November 1983), DE-27 25 743-A1, EP-00 32 456-B, EP-01 26 000-A2, EP-01 38 200-A2, EP-02 03 521-A2, EP-02 17 310-A2, EP-02 53 665-A2, EP-03 24 391-A2, EP-03 24 426-A2, EP-03 26 443-A2, EP-03 56 898-A2, EP-04 73 342-A1, and EP-05 01 546-A1.

Examples of suitable hydrazine compounds are

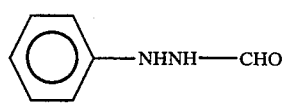

(H-1)

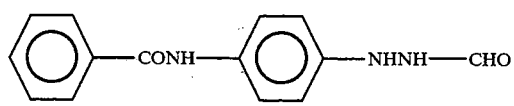

(H-2)

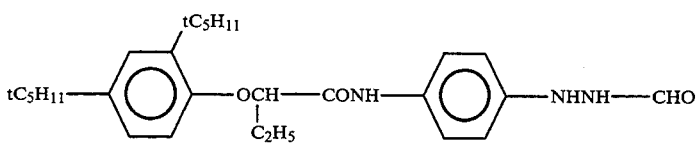

(H-3)

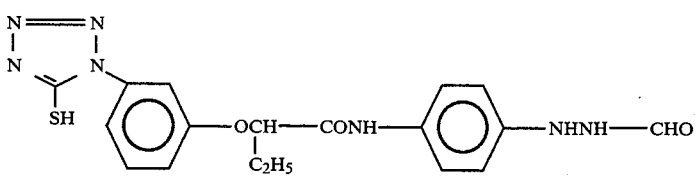

(H-4)

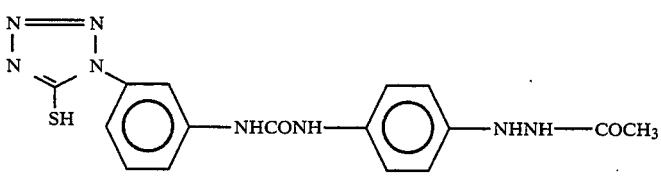

(H-5)

-continued

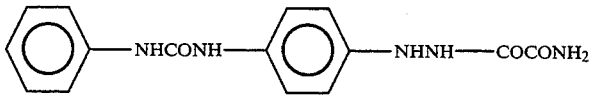

(H-6)

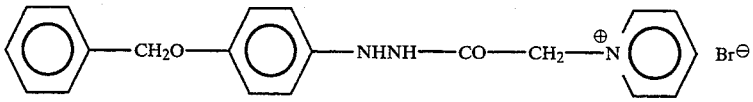

(H-7)

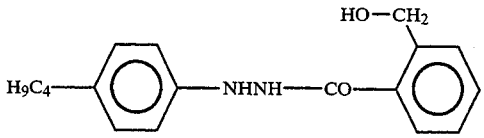

(H-8)

The layers of the invention's recording materials can be hardened with a known agent. This hardening agent can be added to the emulsion layer or to an auxiliary layer, for example, an outer protective coating. Preferred hardening agents are hydroxydichlorotriazine, dihydroxydioxane, divinyl sulfones, and biscarbamoyl imidazoles. The layers of the invention's recording materials can also contain known polymer dispersions to improve, for example, the dimensional stability of the photographic material. These dispersions are generally latexes of hydrophobic polymers in an aqueous matrix. Examples of suitable polymer dispersions are cited in Research Disclosure 308 119, Section IX B. Polymers or copolymers of various acrylic acid esters with particle sizes below 100 nm are preferred.

All of the photosensitive layers of the invention's recording materials can be coated on one side of the support in a layer system such that the other side of the support remains uncoated or has non-photosensitive auxiliary layers, for example, for antihalation and for planarity. However, the invention also includes materials having both sides of the support coated with photosensitive layer systems of at least one photosensitive silver halide emulsion layer and an outer protective layer.

In addition to the photosensitive silver halide emulsion layers and outer protective coating, the layer systems can contain other layers, for example, filter layers or layers to facilitate adhesion or the coating process.

Any known support can be used, especially flexible supports, for example, sheets of polyesters, such as polyethylene terephthalate or cellulose esters, and paper, preferably with a hydrophobic coating.

The invention's recording materials can be formulated so that the proportion of the hydrophilic colloid in the emulsion and protective layers is low. Such materials are especially suitable for rapid processing.

The invention's recording materials can be used in all fields of photographic and radiographic image production, especially for reproducing color images in stages preliminary to printing and in recording x-ray images for medical diagnostics.

In the subsequent examples, the following known agents or the invention's agents for reducing pressure sensitivity were used:

L1-aqueous dispersion of styrene/methyl methacrylate copolymer (30/70), molar mass: about 100,000 g/mole, particle size: 100 nm, solids content: 40 percent by weight.

L2-aqueous dispersion of polyethylene, molar mass: 20,000 g/mole, particle size: 200 nm, solids content: 20 percent by weight.

L3-aqueous dispersion (latex) of polyethyl acrylate, molar mass: about 100,000 g/mole, particle size: 100 nm, solids content: 30 percent by weight.

L4-aqueous dispersion of ethylene/vinyl acetate copolymer (90/10), molar mass: 6000 g/mole, particle size: 500 nm, solids content: 20 percent by weight.

L5-aqueous dispersion of ethylene/acrylic acid copolymer (92.5/7.5), molar mass: 6000 g/mole, particle size: 150 nm, solids content: 20 percent by weight.

KK-colloidal silica in water, particle size: 20 nm, solids content: 30 percent by weight.

PO-aqueous dispersion of polyethylene oxidate, molar mass: 8000 g/mole, ball-puncture resistance: about 1000 bar, acid number: 22 mg KOH/g, particle size: 100 nm, solids content: 35 percent by weight, melting point: 130° C.

HQ -hydroquinone (aqueous solution).

The stated quantities are always related to the solid in these dispersions.

EXAMPLE 1.

A silver halide emulsion (Cl/Br=80/20) of cubic grains with an average edge length of 0.21 μm was prepared by pAg- controlled double jet precipitation. After the soluble salts were removed by the flocculation method, the emulsion was ripened chemically with gold and thiosulfate to optimum short time exposure sensitivity. An optical sensitizer for the blue-green spectral range, the usual stabilizers, coating aids, and the latex L3 were added. The emulsion contained 0.5 g of gelatin and 0.1 g of L3 per gram of silver.

Aqueous coating solutions for the protective layers were prepared from gelatin and the additives shown in Table 1 . These solutions were coated together with the emulsions on polyethylene terephthalate 'supports having an adhesive layer and an antihalation backing, and dried. The protective coatings also contained 30 mg/m$^2$ of a precipitated silica (particle size: 5 μm) as a matte agent and 60 mg/m$^2$ of octylphenol diethoxy sulfonic acid (sodium salt) as a coating aid. The coating weight of the emulsion layer was 4.4 g of silver per square meter, and that of the protective layers is shown in Table 1.

Samples of the resulting recording materials were exposed through a step wedge with white light for $2\times10^{-5}$ second and processed in a roll development machine with a commercial developer for rapid processing of line and screen films [CUFD from Du Pont de Nemours (Deutschland) GmbH]. Development took 25 seconds (s) at 36° C. No difference was observed among the test samples from the standpoint of sensitivity, contrast, maximum density, and fog.

Susceptibility to pressure sensitization was tested by drawing a cemented carbide tip (surface radius of curvature: 0.5 mm) at 18 mm/s under loads of 1 to 11N over the surface of the emulsion side of unexposed samples on a flat glass plate. The samples were processed as described above. The lowest load causing a pressure mark on the developed film recognizable with the naked eye served as a measure of susceptibility to pressure sensitization.

Haze in the films was measured on unexposed, undeveloped, fixed, and dried samples with a Type XL-211 Hazegard® hazemeter from Gardener Instruments Company. The proportion of scattered light intensity relative to incident light intensity is shown.

Results are compiled in Table 1 .

TABLE 1

| | Protective Layer | | | | | |
|---|---|---|---|---|---|---|
| Test | Gelatin ($g/m^2$) | Additive ($g/m^2$) | Coating Weight ($g/m^2$) | Pressure Marks at (N) | Haze (%) | Remarks |
| 1 | 0.7 | — | 0.8 | <1 | 7.4 | |
| 2 | 1.5 | — | 1.6 | <1 | 7.6 | |
| 3 | 0.7 | L1, 0.4 | 1.2 | <1 | | |
| 4 | 0.7 | L1, 0.8 | 1.6 | <1 | | |
| 5 | 0.7 | L2, 0.4 | 1.2 | 2 | 9.6 | |
| 6 | 0.7 | L2, 0.8 | 1.6 | 4 | 10.0 | Dirt |
| 7 | 0.7 | KK, 0.4 | 1.2 | <1 | | |
| 8 | 0.7 | KK, 0.8 | 1.6 | <1 | | |
| 9 | 0.7 | L3, 0.4 | 1.2 | <1 | | Dirt |
| 10 | 0.7 | L3, 0.8 | 1.6 | <1 | | Dirt |
| 11 | 0.7 | L4, 0.4 | 1.2 | <1 | | Dirt |
| 12 | 0.7 | L4, 0.8 | 1.6 | <1 | | Dirt |
| 13 | 0.7 | L5, 0.4 | 1.2 | <1 | | |
| 14 | 0.4 | PO, 0.3 | 0.8 | 6 | 7.4 | |
| 15 | 0.7 | PO, 0.2 | 1.0 | 5 | 6.9 | |
| 16 | 0.7 | PO, 0.4 | 1.2 | >11 | 7.4 | |
| 17 | 0.4 | PO, 0.8 | 1.3 | >11 | 7.1 | |

The results show that only the addition of the polyethylene oxidate (Tests 14–17) yields high protection against: pressure sensitization. The total coating weight of the overcoating is of minor significance. The addition of polymer can thus be counterbalanced by omission of gelatin. Tests 14 and 17 also show that large quantities of polyethylene oxidate can be added to the layer without causing haze. Comparison Test 6 does indeed show considerably improved protection against pressure sensitization, but the additive is not useful in practice because of high haze in the layer and dirt pickup during processing.

Tests 3, 4, 7, and 8 show that adding dispersions of the known "hard" fillers, silica and styrene/methyl methacrylate copolymers, to the protective layer does not yield a definite decrease in sensitivity to pressure marks.

EXAMPLE 2

A silver bromide emulsion of cubic grains with an edge length of 0.2 μm was prepared by pAg-controlled double jet precipitation. This emulsion was flocculated, washed, and ripened chemically with 0.3 mmole of thiosulfate per mole of silver. $5\times10^3$mole of potassium iodide per mole of silver, a sensitizer for the green spectral range, 1 mmole of hydrazine compound H-7 per mole of silver, and a coating aid were added. This emulsion was coated together with a protective layer on a polyethylene terephthalate support. The silver coating weight was 3.5 $g/m^2$. The protective layer comprised 0.8 $g/m^2$ of gelatin and the additives listed in Table 2. The layer also contained 2,4-dichloro-6-hydroxytriazine as a hardener and the matte agent of Example 1.

Sensitometry was tested by contact exposure of samples of this film with white light through a transparency with a continuous tone wedge and a contact halftone screen over a continuous tone wedge. The exposed films were processed in a roll development machine with a commercial, high contrast, rapid access developer and a hardener-fixer bath. The development time was 40 s at 38° C. The developed film samples were measured for minimum and maximum density ($D_{min}$ and $D_{max}$ respectively), sensitivity, S, for the 50% halftone value, relative to Test 18 for comparison, and average gradation between density values 2 and 4.

Sensitivity to pressure marks was tested as in Example 1, but the samples were processed under the same conditions as for the sensitometric tests. The results of the evaluations are summarized in Table 2.

The results show that a significant decrease in susceptibility to pressure marks without other disadvantages is achieved only by Tests 26 and 27 according to the invention. The polyethylene dispersion L2 does indeed effect a certain decrease, but haze increases greatly. The favorable effect of hydroquinone is linked with a sharp decrease in sensitivity and contrast.

TABLE 2

| Test | Additive | Quantity ($g/m^2$) | $D_{min}$ | $D_{max}$ | S | G | Pressure Marks at (N) | Haze (%) |
|---|---|---|---|---|---|---|---|---|
| 18 | — | — | 0.04 | 5.8 | 1.00 | >25 | <1 | 7.0 |
| 19 | HQ | 0.15 | 0.04 | 5.8 | 0.75 | 18 | 5 | 8.4 |
| | L2 | 0.20 | | | | | | |
| 20 | KK | 0.40 | 0.04 | 5.6 | 0.92 | >25 | <1 | 7.0 |
| 21 | KK | 0.40 | 0.04 | 5.8 | 0.92 | 25 | 2 | 7.9 |
| | L2 | 0.20 | | | | | | |
| 22 | L1 | 0.40 | 0.04 | 5.8 | 0.88 | >25 | <1 | 7.0 |
| 23 | L1 | 0.40 | 0.04 | 5.8 | 0.88 | 25 | 3 | 8.2 |
| | L2 | 0.20 | | | | | | |
| 24 | L2 | 0.20 | 0.04 | 5.8 | 1.00 | >25 | 4 | 8.6 |
| 25 | L2 | 0.40 | 0.04 | 5.8 | 0.96 | >25 | 9 | 9.1 |
| 26 | PO | 0.20 | 0.04 | 5.8 | 1.05 | >25 | 9 | 6.8 |
| 27 | PO | 0.40 | 0.04 | 5.8 | 1.05 | >25 | >11 | 7.0 |

What is claimed is:

1. A photosensitive silver halide recording material with a support and at least one layer system of at least one silver halide emulsion layer and an outer protective layer containing a hydrophilic colloid on the side of the layer system away from the support, characterized in that the protective layer contains a polyolefin oxidate.

2. The photosensitive silver halide recording material according to claim 1, characterized in that the hydrophilic colloid in the protective layer is gelatin.

3. The photosensitive silver halide recording material according to claim 1, characterized in that the polyolefin oxidate is a polyethylene oxidate.

4. The photosensitive silver halide recording material according to claim 1, characterized in that the proportion of the polyolefin oxidate in the protective layer is 5 to 70 percent by weight, relative to the hydrophilic colloid.

5. The photosensitive silver halide recording material according to claim 1, characterized in that the polyolefin oxidate has a ball-puncture resistance of 150 to 1100 bar.

6. The photosensitive silver halide recording material according to claim 1, characterized in that the polyolefin oxidate has an acid number of 10 to 35 mg KOH per gram.

7. The photosensitive silver halide recording material according to claim 1, characterized in that the polyolefin oxidate has a molar mass of 3000 to 8000 g/mole.

8. The photosensitive silver halide recording material according to claim 1, characterized in that the particle size of the polyolefin oxidate in the protective layer is between 50 and 100 nm.

9. The photosensitive silver halide recording material according to claim 1, further comprising a hydrazine compound in at least one silver halide emulsion layer or in a layer with a reactive relationship to the emulsion layer.

* * * * *